US010008802B1

(12) United States Patent
Hoglund

(10) Patent No.: US 10,008,802 B1
(45) Date of Patent: Jun. 26, 2018

(54) RECEPTACLE FRAMES FOR ADAPTING A FLOAT RANGE CAPABILITY OF A BLIND-MATE CONNECTOR AND RELATED SYSTEMS

(71) Applicant: Eaton Corporation, Cleveland, OH (US)

(72) Inventor: Justin Raymond Hoglund, Wake Forest, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days. days.

(21) Appl. No.: 15/494,711

(22) Filed: Apr. 24, 2017

(51) Int. Cl.
*H01R 13/518* (2006.01)
*H01R 13/631* (2006.01)
*H01R 13/73* (2006.01)

(52) U.S. Cl.
CPC ..... *H01R 13/518* (2013.01); *H01R 13/6315* (2013.01); *H01R 13/73* (2013.01)

(58) Field of Classification Search
CPC ... H01R 13/518; H01R 13/6315; H01R 13/73
USPC ..... 439/248, 247
See application file for complete search history.

(56) References Cited

U.S. PATENT DOCUMENTS 4,697,859 A * 10/1987 Fisher, Jr. ..... H01R 13/6315 439/246
5,002,497 A * 3/1991 Plocek ..... H01R 13/6315 439/247
5,383,790 A * 1/1995 Kerek ..... H01R 13/6315 439/152
5,931,688 A * 8/1999 Hasz ..... H01R 13/748 439/247
5,980,290 A * 11/1999 Meynier ..... H01R 13/6315 439/246
6,146,184 A * 11/2000 Wilson ..... H01R 12/7005 439/248
6,176,738 B1 * 1/2001 Consoli ..... H01R 13/631 439/545
6,773,286 B1 * 8/2004 Wu ..... H01R 13/629 439/247
6,848,925 B2 * 2/2005 Nishide ..... H01R 13/73 439/157
8,628,340 B2 * 1/2014 Chiu ..... H01R 13/6594 439/83
8,801,460 B2 * 8/2014 Van Swearingen ..... H01Q 1/00 439/578
8,879,953 B2 * 11/2014 Amann ..... G03G 15/0863 399/111
9,551,974 B1 * 1/2017 Martin ..... G03G 21/1652
2011/0065300 A1 * 3/2011 Kobayashi ..... H01R 13/6315 439/248
2016/0204536 A1 * 7/2016 Doi ..... H01R 12/65 439/248

* cited by examiner

*Primary Examiner* — Alexander Gilman
(74) *Attorney, Agent, or Firm* — Ward and Smith, P.A.

(57) ABSTRACT

A receptacle frame is provided including a frame having tapered sidewalls and ends of the tapered sidewalls having tapered leads thereon, the tapered sidewalls of the frame defining an opening therethrough; at least one mounting slot on the frame to secure the receptacle frame to a back plane of an electrical enclosure; and at least one mounting point on the frame to secure a blind-mate receptacle portion of a blind-mate connector to the receptacle frame. Related systems are also provided.

18 Claims, 4 Drawing Sheets

RECEPTACLE FRAMES FOR ADAPTING A FLOAT RANGE CAPABILITY OF A BLIND-MATE CONNECTOR AND RELATED SYSTEMS

FIELD

The inventive concept relates generally to connectors and, more particularly, to blind-mate connectors and related methods, systems and devices.

BACKGROUND

Electrical connections are inherently dangerous to connect and disconnect, thus, proper personal protection equipment (PPE) is necessary and can make the process of servicing the electrical connection burdensome, difficult, or time consuming. In addition, access to electrical connections within electrical equipment can be difficult or impossible due to obstructions to or placement of the electrical equipment, such as placing the equipment against a wall. Therefore, it is necessary in many cases to design an electrical connection so that it can be connected or disconnected by means of a plug. Many of these electrical connections are located in the rear portion of an electrical enclosure.

Since access to the rear of the electrical enclosure is not always feasible, the plug, is typically plugged in blind, i.e. without seeing the receptacle or the plug. Blind-mate receptacles and plugs that simplify the blind plug in process are available. However, off the shelf plugs/receptacles do not suit all environments and custom plugs/receptacles can be very expensive.

SUMMARY

Some embodiments of the inventive concept provide a receptacle frame including a frame having tapered sidewalls and ends of the tapered sidewalls having tapered leads thereon, the tapered sidewalls of the frame defining an opening therethrough; at least one mounting slot on the frame to secure the receptacle frame to a back plane of an electrical enclosure; and at least one mounting point on the frame to secure a blind-mate receptacle portion of a blind-mate connector to the receptacle frame.

In further embodiments, the frame may be configured to receive the blind-mate receptacle portion and increase the float range of the blind-mate connector associated therewith.

In still further embodiments, the tapered sidewalls and tapered leads of the frame may be configured to guide a blind-mate plug portion of the blind-mate connector into the blind-mate receptacle portion of the blind-mate connector.

In some embodiments, at least one mounting point may be configured to secure the blind-mate receptacle portion of the blind-mate connector to the receptacle frame using one of screws, pins, snap features and adhesives.

In further embodiments, the opening may be configured such that the wires and connectors associated with the blind-mate connector pass through the receptacle frame and make a proper electrical connection.

In still further embodiments, the receptacle frame may be plastic.

In some embodiments, an allowed tolerance stack-up of system parts between the receptacle frame including the blind-mate connector may be less than 2.8 mm for a 100% reliable blind-mate design.

In further embodiments, a tolerance stack up of system parts between the receptacle frame including the blind-mate connector may be about 2.0 mm more than conventional systems.

Still further embodiments of the present inventive concept provide a float mounting system including a blind-mate connector including a blind-mate receptacle portion and a blind-mate plug portion; and a receptacle frame configured to be mounted to a back plane of an electrical enclosure and receive the blind-mate connector therein such that a float range of the float mounting system is greater than about 2.8 mm.

DETAILED DESCRIPTION

Figures 1A, 1B:
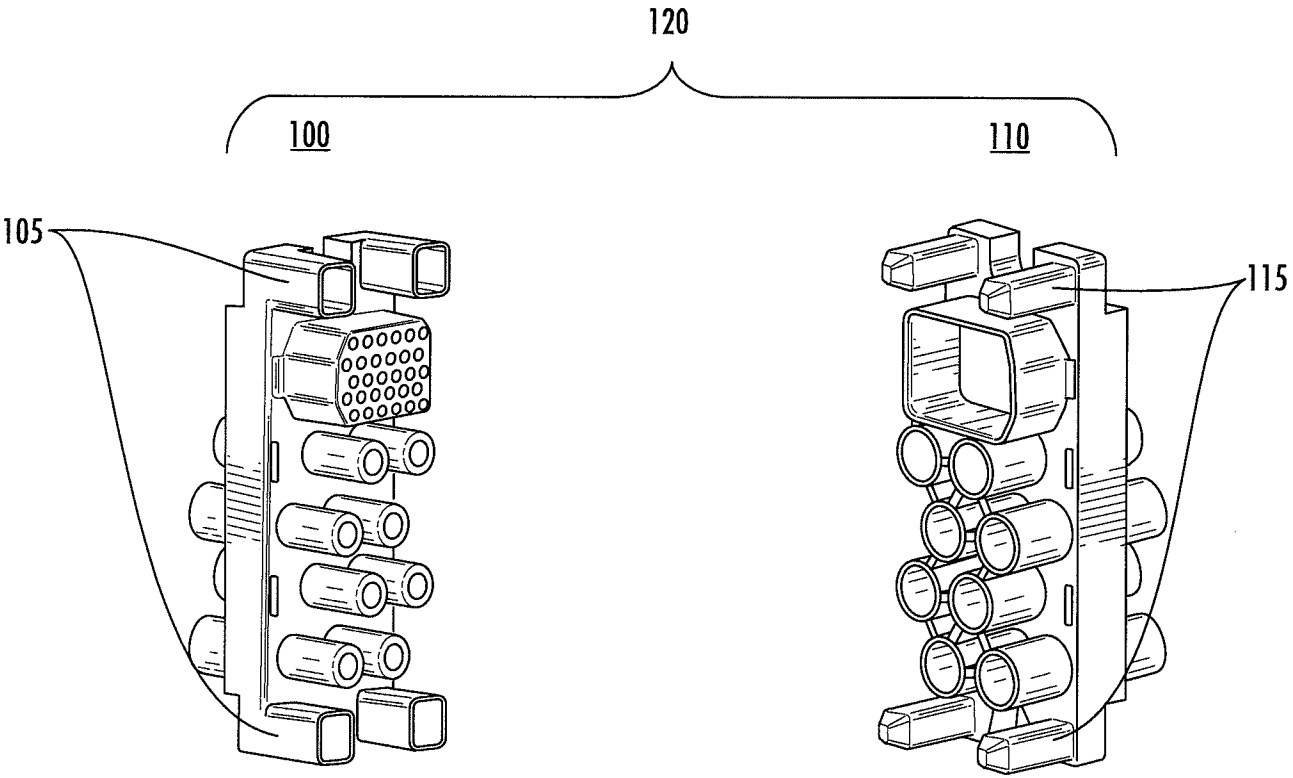
FIG. 1A is a diagram of a blind-mate receptacle.
FIG. 1B is a diagram of a blind-mate plug.

Specific exemplary embodiments of the inventive concept now will be described with reference to the accompanying drawings. This inventive concept may, however, be embodied in many different forms and should not be construed as limited to the embodiments set forth herein; rather, these embodiments are provided so that this disclosure will be thorough and complete, and will fully convey the scope of the inventive concept to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive concept. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

As discussed above, although blind-mate receptacles and plugs are available, improved methods of providing a larger float range for a blind-mate connector may be desirable. In particular, non-custom blind-mate connectors are designed for a fixed amount of float range to accommodate tolerance stack-up between the plug and the receptacle. As used herein, a tolerance stack-up refers to the geometric offset from a nominal position of concern due to the cumulative effect of part tolerances in a system of parts. In many system designs, controlling the tolerance stack-up within the blind-mate connectors designed float range and lead in capability can become cost prohibitive or at worst, not possible within the system constraints. Furthermore, designing and using a custom blind-mate connector can also be cost prohibitive.

Referring now to FIGS. 1A and 1B, a blind-mate connector 120 including a blind-mate receptacle 100 and a blind-mate plug 110, respectively, will be discussed. As illustrated in FIG. 1A, the blind-mate receptacle 100 includes four female guide receptacles 105 configured to receive four corresponding male guide posts 115 on the blind-mate plug 110. As further illustrated in FIG. 1B, the male blind-mate guide posts 115 include tapered surfaces to guide the blind-mate receptacle 100 into the proper position with respect to the male guide posts 115 on the blind-mate plug 110 prior to the electrical contacts engagement. Once the blind-mate receptacle 100 is properly positioned on the blind-mate plug 110, the electrical connection is complete.

The taper of the male guide post 115 of the blind-mate plug 110 is referred to as a "lead in" and it is one of the features that define the reliable engagement of a blind-mate connector. Other features that define the reliable engagement of the blind-mate connector 120 are the mounting post gap and tolerance stack-up inherent to the specific connector design. These features together define the "float range" of a particular connector. As used herein, a "float range" refers to a range which a plug may freely move within the constraints of the mounting features. The range includes a distance on either side of the receptacle as well as a distance up and down. In other words, the float range refers to the size of a mounting gap post plus the tolerance inherent in the connector design as will be discussed further below. It will be understood that the plug and receptacle illustrated in FIGS. 1A and 1B are provided for example only and that other configurations exist.

Figures 2A, 2B:
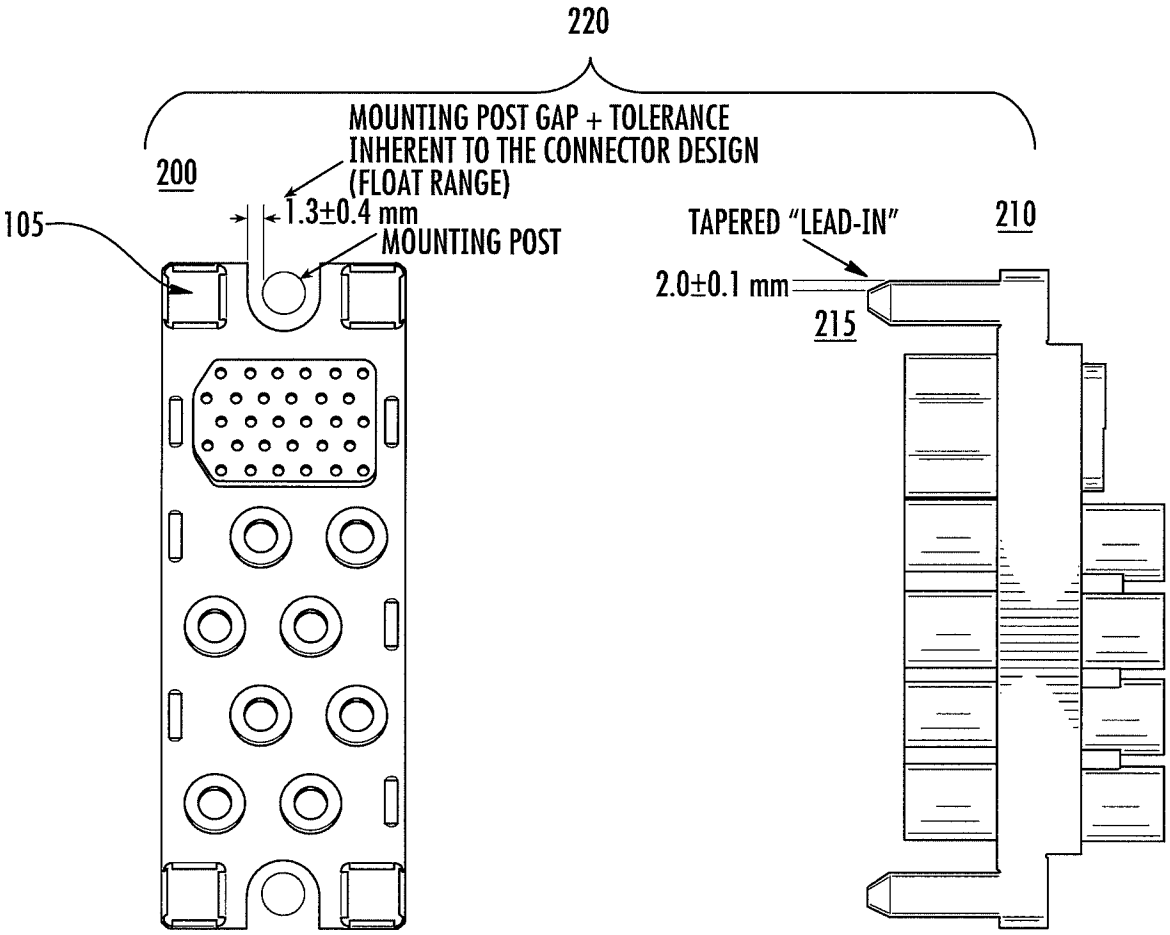
FIG. 2A is a diagram of a back surface of the blind-mate receptacle of FIG. 1A.
FIG. 2B is a side view of the blind-mate plug of FIG. 1B.

Referring now to FIGS. 2A and 2B, a blind-mate connector 220 including a receptacle 200 and plug 210 will be discussed. For a reliable blind-mate design a minimum tapered lead-in 215 generally exceeds a maximum float and a minimum float must exceed a tolerance stack-up of all the parts and features between the receptacle and plug. For example, a typical off the shelf blind-mate plug's 210 tapered lead in 215 equals 2±0.1 mm and the float range of the connector 220 equals 1.3±0.4 mm. The minimum lead in is 1.9 mm and the maximum float is 1.7 mm. The minimum float is 0.9 mm. Therefore, the allowed tolerance stack-up of all remaining system parts between the receptacle 200 and the plug 210 must be less than 0.9 mm for a 100% reliable blind-mate design using the connector as specified by the vendor. 0.9 mm of allowed tolerance stack-up may not be cost feasible in many system level applications.

Accordingly, some embodiments of the present inventive concept provide a receptacle frame for use of an off the shelf blind-mate connector in moderate to high tolerance stack-up system level designs. The receptacle frame in accordance with embodiments of the present inventive concept may allow for a greater tolerance stack-up between an off the shelf blind-mate receptacle and plug than using the blind-mate connector as specified by the vendor as will be discussed further below with respect to FIGS. 2A through 5E.

Conventionally, a blind-mate receptacle portion (100, 200) of the blind-mate connector (120, 220) is mounted onto a "back-plane" surface of an electrical enclosure. The blind-mate plug portion (110, 210) is mounted onto a "retractable or sliding drawer" that is configured to fit in the electrical enclosure. Thus, when the drawer is closed, the blind-mate plug is configured to couple the blind-mate receptacle and form the electrical connection. Accordingly, the design of the back plane, the rail system guiding the drawer, and the drawer itself are important to the tolerance stack-up of the blind-mate mating system. A feasible tolerance stack-up in this type of system application would be in the range of 2.0-3.0 mm without substantial increase costs.

Figure 3B:
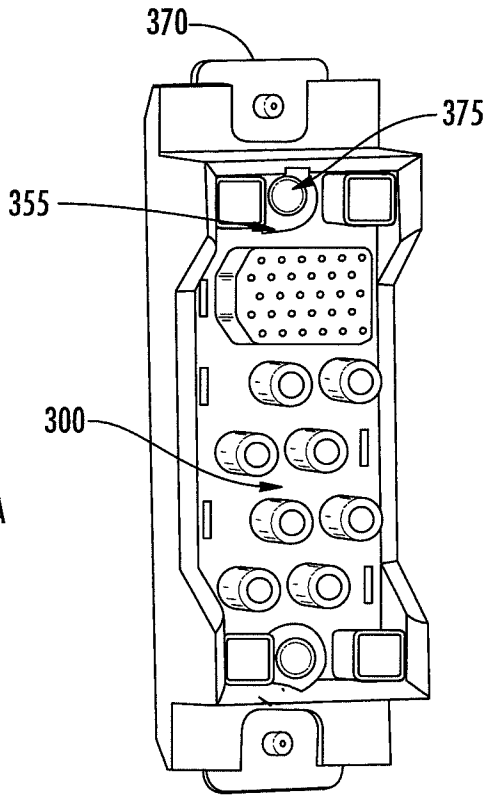
FIG. 3B is a diagram showing a conventional blind-mate receptacle positioned in the receptacle frame in accordance with embodiments of the present inventive concept.
Figure 3A:
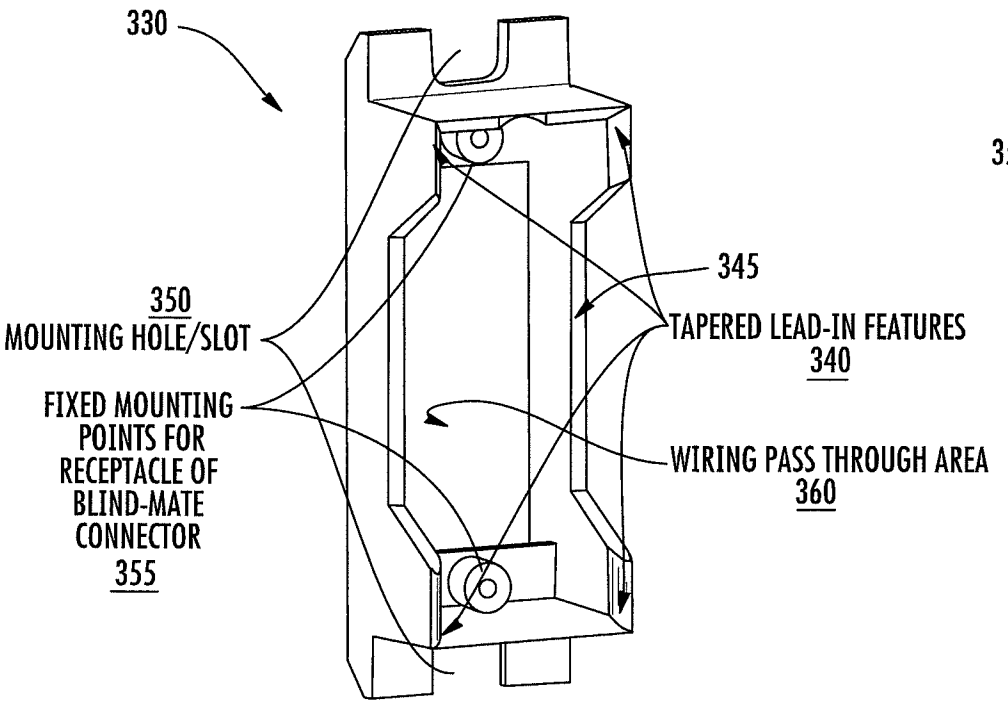
FIG. 3A is a perspective view of a receptacle frame in accordance with some embodiments of the present inventive concept.

Referring now to FIGS. 3A and 3B, a receptacle frame 330 in accordance with some embodiments of the present inventive concept will be discussed. In particular, FIG. 3A is a perspective view of the receptacle frame 330 in accordance with embodiments of the present inventive concept. FIG. 3B is a diagram showing a conventional blind-mate receptacle 300 positioned in the receptacle frame 330 in accordance with embodiments of the present inventive concept. As illustrated in FIG. 3A, the receptacle frame 330 includes mounting holes/slots 350 that are used to secure the receptacle frame to the back plane of the electrical enclosure; mounting points 355 that are used to mount a receptacle portion 300 (FIG. 3B) of the blind-mate connector to the receptacle frame 330; tapered sidewalls/leads 340/345 configured to guide the receptacle portion of the blind-mate connector onto the proper plug portion; and an area/opening 360 that allows wires and connectors to pass through the receptacle frame 330. Provision of the blind-mate receptacle 300 in the receptacle frame 330 as shown in FIG. 3B allows a float range capability of an off the shelf blind-mate connector to be adapted, for example, made larger without having to change the size or configuration of the electrical enclosures or the equipment positioned therein. As further illustrated in FIG. 3B, the receptacle frame provides mounting points 355 which may be configured to receive screws, pins, snap features or adhesives 375 to hold the blind-mate receptacle 300 in the receptacle frame 330.

Figure 4:
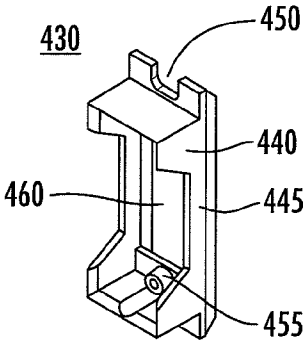
FIG. 4 is a perspective view of receptacle frame in accordance with some embodiments of the present inventive concept.

Referring now to FIG. 4, a perspective view of a receptacle frame 430 in accordance with embodiments of the present inventive concept will be discussed. As discussed above, the receptacle frame includes mounting holes/slots 450; mounting points 455; tapered sidewalls/leads 440; and an area/opening 460. As discussed above, a conventional blind-mate receptacle fix mounts (FIG. 3B) to the receptacle frame 430 at the mounting points 455, which is mounted to the back plane of the electrical enclosure using the mounting holes/slots 450. The receptacle frame 430 float mounts to the back plane surface. The tapered sidewalls/leads 440/445 of the receptacle frame 430 plus the tapered lead (115, 215) of the standard blind-mate plug provides a new total lead in of the blind-mate connector. Thus, the receptacle frame 430 provides for a float mounting system having larger float ranges and lead-ins.

For example, as discussed above, a standard blind-mate connectors tapered lead in equals 2±0.1 mm and the receptacle frame lead in equals 2.0±0.1 mm. In some embodiments, a receptacle frame 430 float range is 3.2±0.4 mm. A minimum lead in of the system is 3.8 mm and the maximum float is 3.6 mm. The minimum float is 2.8 mm. Thus, the allowed tolerance stack-up of all remaining system parts between the receptacle and the plug must be less than 2.8 mm for a 100% reliable blind-mate design using the new system combining the standard connector in addition with the receptacle frame 430. This is a significant increase over the 0.9 mm tolerance stack-up of the conventional blind-mate connector alone.

It will be understood that the receptacle frames 330, 430 illustrated in FIGS. 3A through 4 are provided for example only and, therefore, embodiments of the present inventive concept are not limited thereto. Furthermore, although embodiments of the present inventive concept are discussed herein as being used in combination with a conventional blind-mate connectors, other connectors including custom blind-mate connectors may be used without departing from the scope of the present inventive concept.

Figure 5A:
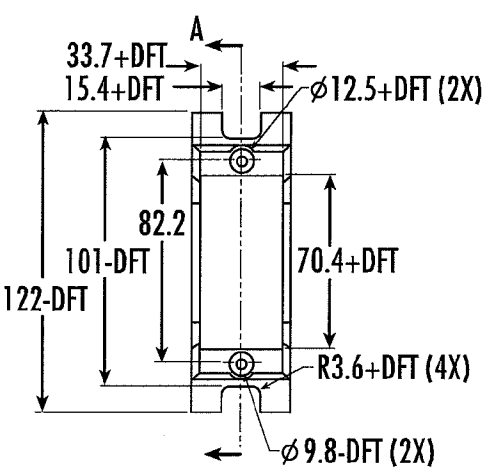
FIGS. 5A through 5E diagrams illustrating various view of the receptacle frame in accordance with some embodiments of the present inventive concept.
Figure 5B:
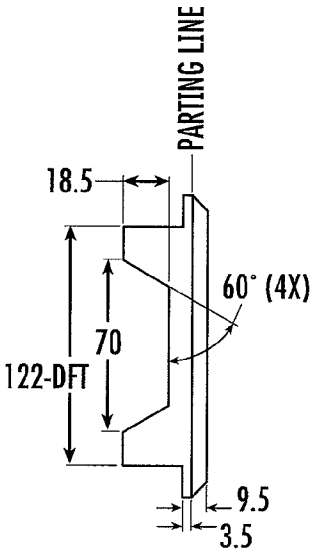
Figure 5E:
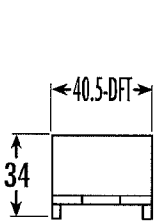
Figure 5D:
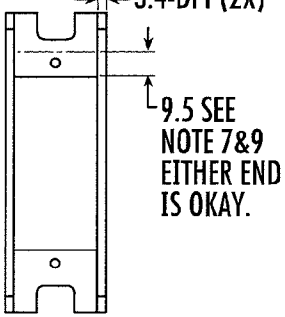
Figure 5C:
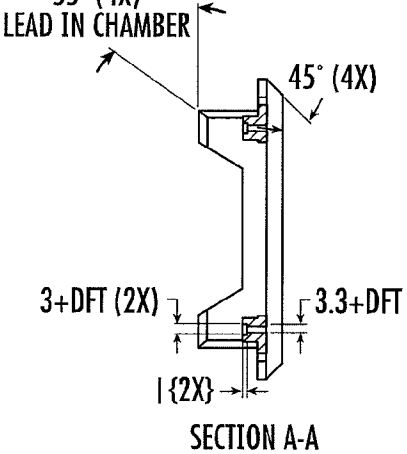

FIGS. 5A through 5E are various views of the receptacle frame in accordance with some embodiments of the present inventive concept. FIG. 5A is a top view of the receptacle frame; FIGS. 5B and 5C are side views of the receptacle frame; FIG. 5D is a back view of the receptacle frame; and FIG. 5E is a cross section of the receptacle frame. Measurements show on FIGS. 5A through 5E are provided as examples only and, therefore, embodiments of the present inventive concept are not limited to this configuration. The receptacle frame may be manufactured from any material suitable to provide a frame for a blind-mate receptacle as discussed herein. For example, the receptacle frame may be plastic in some embodiments. However, in a non-electrical application, other materials including metal may be used.

In the drawings and specification, there have been disclosed example embodiments of the inventive concept. Although specific terms are employed, they are used in a generic and descriptive sense only and not for purposes of limitation, the scope of the inventive concept being defined by the following claims.

That which is claimed:

1. A receptacle frame comprising:

a frame having first and second opposing, tapered sidewalls, each of the first and second tapered sidewalls having first and second ends and the first and second ends of each tapered sidewall having corresponding first and second tapered leads thereon, the tapered sidewalls of the frame defining an opening therethrough;

at least one mounting slot on the frame to secure the receptacle frame to a back plane of an electrical enclosure; and at least one mounting point on the frame to secure a blind-mate receptacle portion of a blind-mate connector to the receptacle frame.

2. The receptacle frame of claim 1, wherein the frame is configured to receive the blind-mate receptacle portion and increase a float range of the blind-mate connector associated therewith.

3. The receptacle frame of claim 2, wherein the tapered sidewalls and tapered leads of the frame are configured to guide a blind-mate plug portion of the blind-mate connector into the blind-mate receptacle portion of the blind-mate connector.

4. The receptacle frame of claim 3, wherein the at least one mounting point is configured to secure the blind-mate receptacle portion of the blind-mate connector to the receptacle frame using one of screws, pins, snap features and adhesives.

5. The receptacle frame of claim 1, wherein the opening is configured such that wires and connectors associated with the blind-mate connector pass through the receptacle frame and make a proper electrical connection.

6. The receptacle frame of claim 1, wherein the receptacle frame comprises plastic.

7. The receptacle frame of claim 1, wherein an allowed tolerance stack-up of system parts between the receptacle frame including the blind-mate connector is less than 2.8 mm for a 100% reliable blind-mate design.

8. The receptacle frame of claim 1, wherein a tolerance stack up of system parts between the receptacle frame including the blind-mate connector is about 2.0 mm more than conventional systems.

9. The receptacle frame of claim 1, wherein the frame has a rectangular shape.

10. A float mounting system, comprising:

a blind-mate connector including a blind-mate receptacle portion and a blind-mate plug portion; and a receptacle frame configured to be mounted to a back plane of an electrical enclosure and receive the blind-mate connector therein such that a float range of the float mounting system is less than about 2.8 mm, wherein the receptacle frame comprises a frame having first and second opposing, tapered sidewalls, each of the first and second tapered sidewalls having first and second ends and the first and second ends of each tapered sidewall having corresponding first and second tapered leads thereon, the tapered sidewalls of the frame defining an opening therethrough.

11. The system of claim 10, wherein the receptacle frame comprises:

at least one mounting slot on the frame to secure the receptacle frame to the back plane of the electrical enclosure; and at least one mounting point on the frame to secure the blind-mate receptacle portion of the blind-mate connector to the receptacle frame.

12. The system of claim 11, wherein the frame is configured to receive the blind-mate receptacle portion and increase the float range of the blind-mate connector associated therewith.

13. The system of claim 12, wherein the tapered sidewalls and tapered leads of the frame are configured to guide the blind-mate plug portion of the blind-mate connector into the blind-mate receptacle portion of the blind-mate connector.

14. The system of claim 13, wherein the at least one mounting point is configured to secure the blind-mate receptacle portion of the blind-mate connector to the receptacle frame using one of screws, pins, snap features and adhesives.

15. The system of claim 11, wherein the opening is configured such that wires and connectors associated with the blind-mate connector pass through the receptacle frame and make a proper electrical connection.

16. The system of claim 11, wherein the receptacle frame comprises plastic.

17. The system of claim 11, wherein an allowed tolerance stack-up of system parts between the receptacle frame including the blind-mate connector is less than 2.8 mm for a 100% reliable blind-mate design.

18. The system of claim 11, wherein a tolerance stack up of system parts between the receptacle frame including the blind-mate connector is about 2.0 mm more than conventional systems.

* * * * *